US006003986A

United States Patent [19]

Keefe

[11] Patent Number: 6,003,986

[45] **Date of Patent: *Dec. 21, 1999**

[54] BUBBLE TOLERANT MANIFOLD DESIGN FOR INKJET CARTRIDGE

[75] Inventor: Brian J. Keefe, La Jolla, Calif.

[73] Assignee: Hewlett-Packard Co., Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/550,143

[22] Filed: Oct. 30, 1995

Related U.S. Application Data

[63] Continuation-in-part of application No. 08/319,896, Oct. 6, 1994, Pat. No. 5,648,805, and a continuation-in-part of application No. 08/319,404, Oct. 6, 1994, Pat. No. 5,604,519, and a continuation-in-part of application No. 08/319,892, Oct. 6, 1994, Pat. No. 5,638,101, and a continuation-in-part of application No. 08/320,084, Oct. 6, 1994, Pat. No. 5,563,642, and a continuation-in-part of application No. 08/319,893, Oct. 6, 1994, Pat. No. 5,594,481.

[51] Int. Cl.[6] ..... B41J 2/19

[52] U.S. Cl. ..... 347/92

[58] Field of Search ..... 347/85, 86, 87, 347/92

[56] References Cited

U.S. PATENT DOCUMENTS

| | | | |
|---|---|---|---|
| 4,312,009 | 1/1982 | Lange . | |
| 4,502,060 | 2/1985 | Rankin et al. . | |
| 4,558,333 | 12/1985 | Sugitani et al. . | |
| 4,587,534 | 5/1986 | Saito et al. . | |
| 4,589,000 | 5/1986 | Koto et al. | 347/92 |
| 4,611,219 | 9/1986 | Sugitani et al. . | |
| 4,683,481 | 7/1987 | Johnson . | |
| 4,695,854 | 9/1987 | Curz-Uribe . | |
| 4,712,172 | 12/1987 | Kiyohara et al. . | |
| 4,734,717 | 3/1988 | Rayfield . | |
| 4,791,440 | 12/1988 | Elridge et al. . | |
| 4,847,630 | 7/1989 | Bhaskar et al. . | |
| 4,882,595 | 11/1989 | Trueba et al. . | |
| 4,942,408 | 7/1990 | Braun . | |
| 4,999,650 | 3/1991 | Braun . | |
| 5,059,989 | 10/1991 | Elridge et al. . | |
| 5,113,205 | 5/1992 | Sato et al. | 347/92 |
| 5,420,627 | 5/1995 | Keefe et al. | 347/87 |
| 5,815,185 | 9/1998 | Pietrzyk | 347/92 |

FOREIGN PATENT DOCUMENTS

| | | | |
|---|---|---|---|
| 314 486 | 3/1989 | European Pat. Off. . | |
| 0419181 | 3/1991 | European Pat. Off. . | |
| 529879 | 3/1993 | European Pat. Off. | 437/87 |
| 0646466 | 4/1995 | European Pat. Off. . | |
| 55079174 | 6/1980 | Japan . | |
| 02004519 | 1/1990 | Japan . | |
| 03208661 | 9/1991 | Japan . | |

*Primary Examiner*—N. Le
*Assistant Examiner*—Judy Nguyen
*Attorney, Agent, or Firm*—Dennis G. Stenstrom

[57] ABSTRACT

In a inkjet print cartridge ink flows from the reservoir around the edge of the silicon substrate before being ejected out of the nozzles. During operation, warm thermal boundary layers of ink form adjacent the substrate and dissolved gases in the thermal boundary layer of the ink form the bubbles. If the bubbles to grow larger than the diameter of subsequent ink passageways these bubbles choke the flow of ink to the vaporization chambers. This results in causing some of the nozzles of the printhead to become temporarily inoperable. The disclosure describes a method of avoiding such a malfunction in a liquid inkjet printing system by providing a bubble tolerant manifold design.

8 Claims, 8 Drawing Sheets

BUBBLE TOLERANT MANIFOLD DESIGN FOR INKJET CARTRIDGE

CROSS-REFERENCE TO RELATED APPLICATIONS

This application is a continuation-in-part of applications: U.S. Ser. No. 08/319,896, filed Oct. 6, 1994, entitled "Inkjet Printhead Architecture for High Speed and High Resolution Printing, now U.S. Pat. No. 5,648,805;" U.S. Ser. No. 08/319,404, filed Oct. 6, 1994, entitled "Inkjet Printhead Architecture for High Frequency Operation, now U.S. Pat. No. 5,604,519;" U.S. Ser. No. 08/319,892, filed Oct. 6, 1994, entitled "High Density Nozzle Array for Inkjet Printhead, now U.S. Pat. No. 5,638,101;" U.S. Ser. No. 08/320,084, filed Oct. 6, 1994, entitled "Inkjet Printhead Architecture for High Speed Ink Firing Chamber Refill, now U.S. Pat. No. 5,563,642;" and U.S. Ser. No. 08/319,893, filed Oct. 6, 1994, entitled "Barrier Architecture for Inkjet Printhead, now U.S. Pat. No. 5,594,481;" and relates to the subject matter disclosed in U.S. patent application, Ser. No. 08/550,437, filed Oct. 30, 1995, now U.S. Pat. No. 5,909,231, entitled "Gas Flush to Eliminate Residual Bubbles", now U.S. Pat. No. 5,909,231. The foregoing patent applications are herein incorporated by reference.

FIELD OF THE INVENTION

The present invention generally relates to inkjet and other types of printers and, more particularly, to the ink flow to the printhead portion of an inkjet printer.

BACKGROUND OF THE INVENTION

An ink jet printer forms a printed image by printing a pattern of individual dots at particular locations of an array defined for the printing medium. The locations are conveniently visualized as being small dots in a rectilinear array. The locations are sometimes called "dot locations", "dot positions", or "pixels". Thus, the printing operation can be viewed as the filling of a pattern of dot locations with dots of ink.

Thermal inkjet print cartridges operate by rapidly heating a small volume of ink to cause the ink to vaporize and be ejected through one of a plurality of orifices so as to print a dot of ink on a recording medium, such as a sheet of paper. Typically, the orifices are arranged in one or more linear arrays in a nozzle member. The properly sequenced ejection of ink from each orifice causes characters or other images to be printed upon the paper as the printhead is moved relative to the paper. The paper is typically shifted each time the printhead has moved across the paper The thermal inkjet printer is fast and quiet, as only the ink strikes the paper. These printers produce high quality printing and can be made both compact and affordable.

An inkjet printhead generally includes: (1) ink channels to supply ink from an ink reservoir to each vaporization chamber proximate to an orifice; (2) a metal orifice plate or nozzle member in which the orifices are formed in the required pattern; and (3) a silicon substrate containing a series of thin film resistors, one resistor per vaporization chamber.

To print a single dot of ink, an electrical current from an external power supply is passed through a selected thin film resistor. The resistor is then heated, in turn superheating a thin layer of the adjacent ink within a vaporization chamber, causing explosive vaporization, and, consequently, causing a drop of ink to be ejected through an associated nozzle onto the paper.

A concern with inkjet printing is the sufficiency of ink flow to the paper or other print media. Print quality is a function of ink flow through the printhead. Too little ink on the paper or other media to be printed upon produces faded and hard-to-read documents.

In an inkjet printhead ink is fed from an ink reservoir integral to the printhead or an "off-axis" ink reservoir which feeds ink to the printhead via tubes connecting the printhead and reservoir. Ink is then fed to the various vaporization chambers either through an elongated hole formed in the center of the bottom of the substrate, "center feed", or around the outer edges of the substrate, "edge feed". In center feed the ink then flows through a central slot in the substrate into a central manifold area formed in a barrier layer between the substrate and a nozzle member, then into a plurality of ink channels, and finally into the various vaporization chambers. In edge feed ink from the ink reservoir flows around the outer edges of the substrate into the ink channels and finally into the vaporization chambers. In either center feed or edge feed, the flow path from the ink reservoir and the manifold inherently provides restrictions on ink flow to the firing chambers.

Air and other gas bubbles can cause major problems in ink delivery systems. Ink delivery systems are capable of releasing gasses and generating bubbles, thereby causing systems to get clogged and degraded by bubbles. In the design of a good ink delivery system, it is important that techniques for eliminating or reducing bubble problems be considered. Most fluids exposed to the atmosphere contain dissolved gases in amounts varying with the temperature. The amount of gas that a liquid can hold depends on temperature and pressure, but also depends on the extent of mixing between the gas and liquid and the opportunities the gas has had to escape.

Changes in atmospheric pressure normally can be neglected because atmospheric pressure stays fairly constant. However, temperature does change within an inkjet cartridge to make an appreciable difference in the amount of gas that can be contained in the ink. Bubbles have less tendency to originate at low temperatures, and their growth will also be slower. The colder a liquid, the less kinetic energy is available and the longer it takes to gather together the necessary energy at specific location where the bubble begins to form.

Most fluids exposed to the atmosphere contain dissolved gases in amounts proportional to the temperature of the fluid itself. The colder the fluid, the greater the capacity to absorb gases. If a fluid saturated with gas is heated, the dissolved gases are no longer in equilibrium and tend to diffuse out of solution. If nucleation seed sites are present along the surface containing the fluid or within the fluid, bubbles will form, and as the fluid temperature rises further, these bubbles grow larger.

Bubbles are not only made of air, but are also made of water vapor and vapors from other ink-vehicle constituents. However, the behavior of all liquids are similar, the hotter the liquid becomes, the less gas it can hold. Both gas release and vapor generation cause bubbles to start and grow as temperature rises. One can reasonably assume the gases inside the bubbles in a water-based ink are always saturated with water vapor. Thus, bubbles are made up both of gases, mostly air, and of ink vehicle vapor, mostly water. At room temperature, water vapor is an almost negligible part of the gas in a bubble. However, at 50° C., the temperature at which an inkjet printhead might operate, water vapor adds importantly to the volume of a bubble. As the temperature rises, the water vapor content of the bubbles increases much more rapidly with temperature than does the air content.

The best conditions for bubble generation are the simultaneous presence of (1) generating or "seed" sites, (2) ink flow and (3) bubble accumulators. These three mechanisms work together to produce large bubbles that clog and stop flow in ink delivery systems. When air comes back out of solution as bubbles, it does so at preferential locations, or generation or nucleation sites. Bubbles like to start at edges and corners or at surface scratches, roughness, or imperfections. Very small bubbles tend to stick to the surfaces and resist floating or being swept along in a current of ink. When the bubbles get larger, they are more apt to break loose and move along. However, if the bubbles form in a corner or other out-of-the-way location, it is almost impossible to dislodge them by ink currents.

While bubbles may not start at gas generating sites when the ink is not flowing past those sites, when the ink is moving, the bubble generation site is exposed to a much larger volume of ink containing dissolved gas molecules. As ink flows past the gas generating site, gas molecules can be brought out of solution to form a bubble and grow; while if the ink was not flowing this would happen less rapidly.

The third contributor to bubble generation is the accumulator or bubble trap, which can be defined as any expansion and subsequent narrowing along an ink passage. This configuration amounts to a chamber on the ink flow path with an entrance and an exit. The average ink flow rate, in terms of volume ink per cross section of area per second, is smaller within the chamber than at the entrance or at the exit. The entrance edge of the chamber will act as a gas generating site because of its sharpness and because of the discontinuity of ink flow over the edge. Bubbles will be generated at this site, and when they become large enough they get moved along toward the exit duct until the exit duct is blocked. Then, unless the system can generate enough pressure to push the bubble through, the ink delivery system will become clogged and ink delivery will be shut down. Thus, the chamber allows bubbles to grow larger than the diameter of subsequent ink passageways which may then become blocked.

During the ink filling and priming process, bubbles are left behind in the print cartridge. Bubbles can interfere with printhead reliability by causing intermittent nozzle problems and local or even global starvation. An important aspect of bubble control is the design of the internal cartridge geometry. The most critical areas for the design is the area around the substrate, headland, manifold, standpipe, and filters. The goals are to minimize dead spaces, streamline the geometry for fluid flow to avoid trapping bubbles during initial priming and to provide a clear path to allow for buoyancy to maximize the easy escape of bubbles from the printhead area into the ink manifold and then to float through standpipe and into filter area. Accordingly, a printhead design to be more tolerant of existing bubbles is desired.

Accordingly, there is a need for a printhead design to eliminate the residual bubbles left in the print cartridge after the ink filling and priming process.

SUMMARY OF THE INVENTION

In a inkjet print cartridge ink flows from the ink reservoir through filters, through a standpipe, through or around the silicon substrate, through ink channels and into vaporization chambers for ejection out of the nozzles. During operation, warm thermal boundary layers of ink form adjacent the substrate and dissolved gases in the thermal boundary layer of the ink form the bubbles. Also, bubbles tend to form at the corners and edges of the walls along the ink flow path. If the bubbles grow larger than the diameter of subsequent ink passageways these bubbles choke the flow of ink to the vaporization chambers. This results in causing some of the nozzles of the printhead to become temporarily inoperable.

The present invention provides a method of avoiding such a malfunction in a liquid inkjet printing system by providing a bubble tolerant print cartridge design and method which allows bubbles to escape from the printhead area of the cartridge. The apparatus and method of ink delivery in an inkjet print cartridge comprises the steps of storing a supply of ink in a reservoir; transporting ink from the reservoir downwardly through a manifold to ink firing chambers; and providing contoured walls along the manifold to allow bubbles to escape from the manifold upwardly away from the ink filing chambers toward the reservoir without interfering with the replenishment of ink into the ink firing chambers.

BRIEF DESCRIPTION OF THE DRAWINGS

The present invention can be further understood by reference to the following description and attached drawings which illustrate the preferred embodiment.

DETAILED DESCRIPTION OF THE PREFERRED EMBODIMENTS

Figure 1:
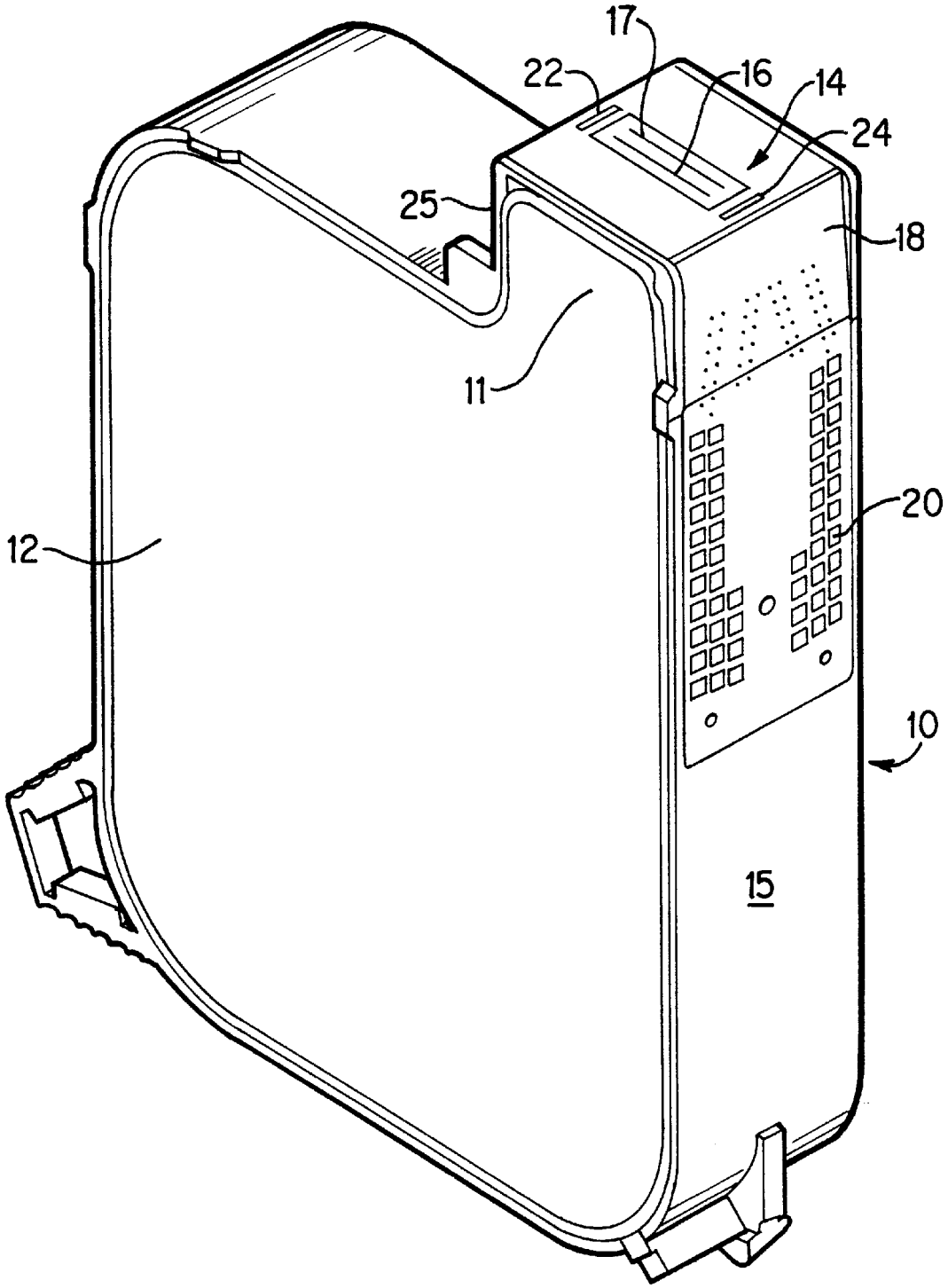
FIG. 1 is a perspective view of an inkjet print cartridge.

Referring to FIG. 1, reference numeral 10 generally indicates an inkjet print cartridge for mounting in the carriage of an inkjet printer. The inkjet print cartridge includes a printhead 14 and an ink reservoir 12, which may be a "integral" reservoir, "snap-on" reservoir, or a "reservoir" for receiving an ink from an off-axis ink reservoir. Print cartridge 10 includes snout 11 which contains an internal standpipe 51 (shown in FIGS. 5 and 7) for transporting ink to the printhead from the reservoir 12. The printhead 14 includes a nozzle member 16 comprising nozzles or orifices 17 formed in a circuit 18. The circuit 18 includes conductive traces (not shown) which are connected to the substrate electrodes at windows 22, 24 and which are terminated by contact pads 20 designed to interconnect with printer providing externally generated energization signals to the printhead for firing resistors to eject ink drops. Printhead 14 has affixed to the back of the circuit 18 a silicon substrate 28 containing a plurality of individually energizable thin film resistors. Each resistor is located generally behind a single orifice 17 and acts as an ohmic heater when selectively energized by one or more pulses applied sequentially or simultaneously to one or more of the contact pads 20.

Figure 2:
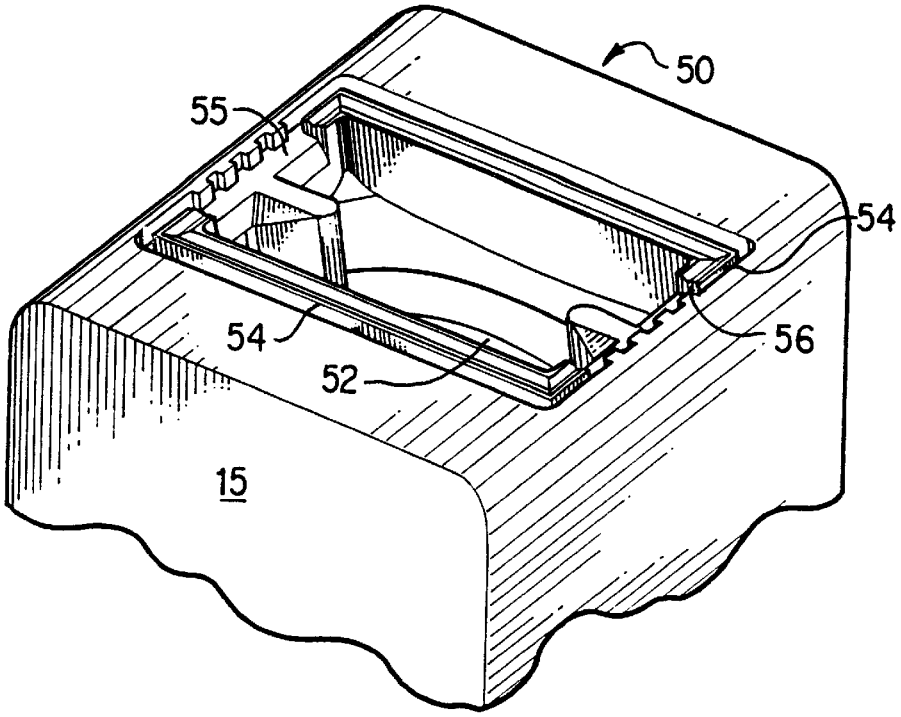
FIG. 2 is a perspective view of the headland area of the inkjet print cartridge of FIG. 1.
Figure 3:
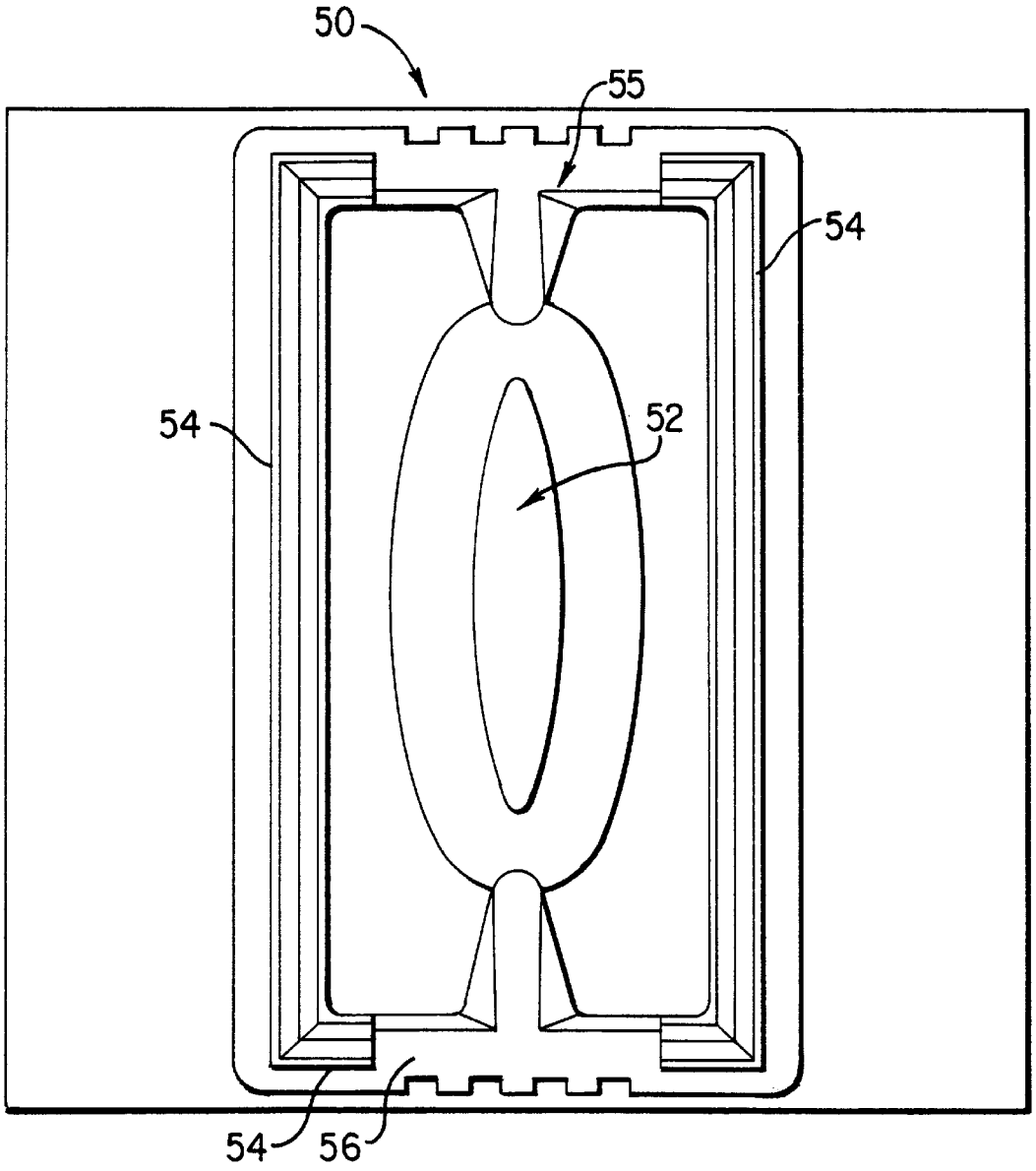
FIG. 3 is a top plan view of the headland area of the inkjet print cartridge of FIG. 1.

FIG. 2 shows the print cartridge 10 of FIG. 1 with the printhead 14 removed to reveal the headland pattern 50 used in providing a seal between the printhead 14 and the print cartridge body 15. FIG. 3 shows the headland area in an enlarged top plan view. Shown in FIGS. 2 and 3 is a manifold 52 in the print cartridge 10 for allowing ink from the ink reservoir 12 to flow to a chamber adjacent the back surface of the printhead 14. The headland pattern 50 formed on the print cartridge 10 is configured so that a bead of adhesive (not shown) dispensed on the inner raised walls 54 and across the wall openings 55 and 56 will form an ink seal between the body 15 of the print cartridge 10 and the back of the printhead 14 when the printhead 14 is pressed into place against the headland pattern 50.

Figure 4:
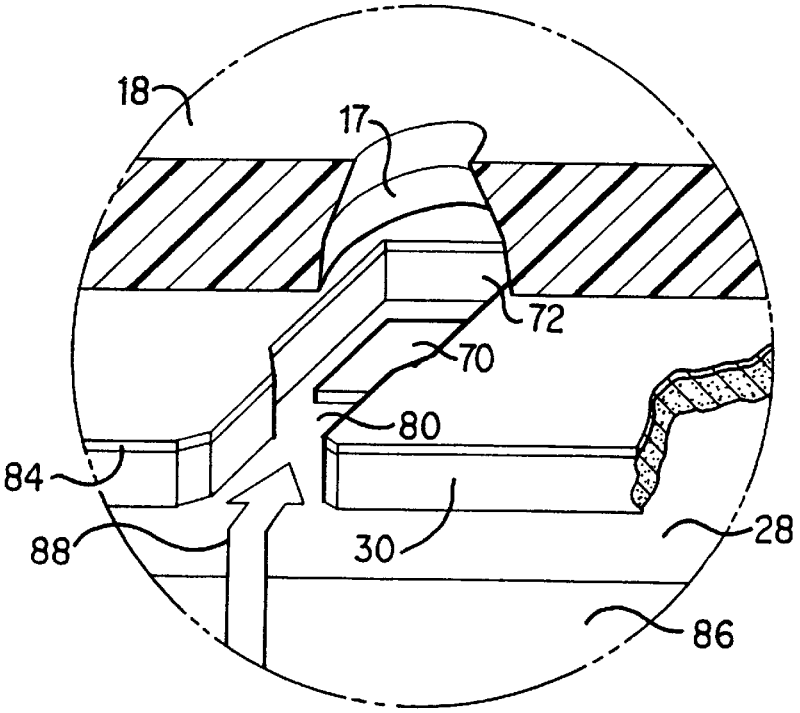
FIG. 4 is a top perspective view, partially cut away, of a portion of the printhead assembly showing the relationship of an orifice with respect to a vaporization chamber, a heater resistor, and an edge of the substrate.

Referring to FIG. 4, shown is an enlarged view of a single vaporization chamber 72, thin film resistor 70, and frustum shaped orifice 17 after the substrate is secured to the back of the circuit 18 via the thin adhesive layer 84. Silicon substrate 28 has formed on it thin film resistors 70 formed in the barrier layer 30. Also formed on the substrate 28 are electrodes (not shown) for connection to the conductive traces (not shown) on the circuit 18. Also formed on the surface of the substrate 28 is the barrier layer 30 in which is formed the vaporization chambers 72 and ink channels 80. A side edge of the substrate 28 is shown as edge 86. In operation, ink flows from the ink reservoir 12 around the side edge 86 of the substrate 28, and into the ink channel 80 and associated vaporization chamber 72, as shown by the arrow 88. Upon energization of the thin film resistor 70, a thin layer of the adjacent ink is superheated, causing explosive vaporization and, consequently, causing a droplet of ink to be ejected through the orifice 17. The vaporization chamber 72 is then refilled by capillary action.

Figure 5:
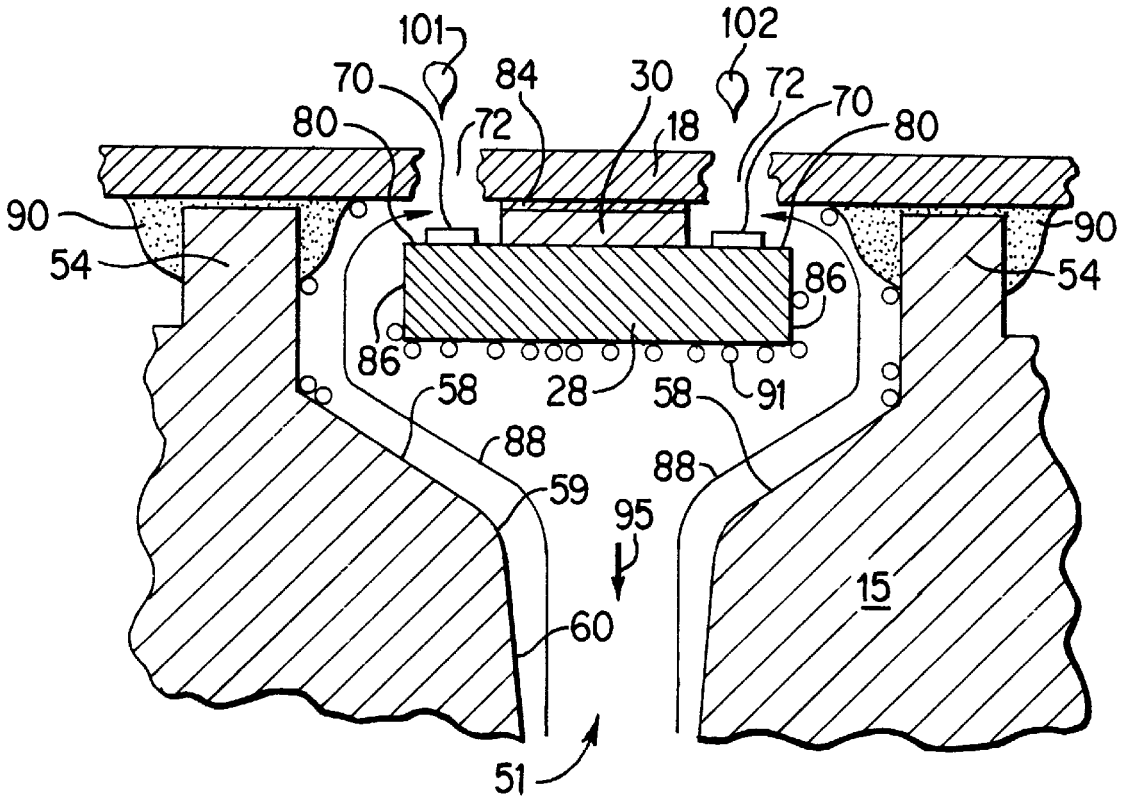
FIG. 5 is a schematic cross-sectional view of a printhead assembly and the print cartridge as well as the ink flow path around the edges of the substrate.

Shown in FIG. 5 is a side elevational cross-sectional view showing a portion of the adhesive seal 90, applied to the inner raised wall 54 portion of the print cartridge body 15 surrounding the substrate 28 and showing the substrate 28 being bonded to a central portion of the circuit 18 on the top surface 84 of the barrier layer 30 containing the ink channels and vaporization chambers 72. A portion of the plastic body 15 of the printhead cartridge 10, including raised walls 54 is also shown.

FIG. 5 also illustrates how ink 88 from the ink reservoir 12 flows through the standpipe 51 formed in the print cartridge 10 and flows around the edges 86 of the substrate 28 through ink channels 80 into the vaporization chambers 72. Thin film resistors 70 are shown within the vaporization chambers 72. When the resistors 70 are energized, the ink within the vaporization chambers 72 are ejected, as illustrated by the emitted drops of ink 101, 102.

Figure 6:
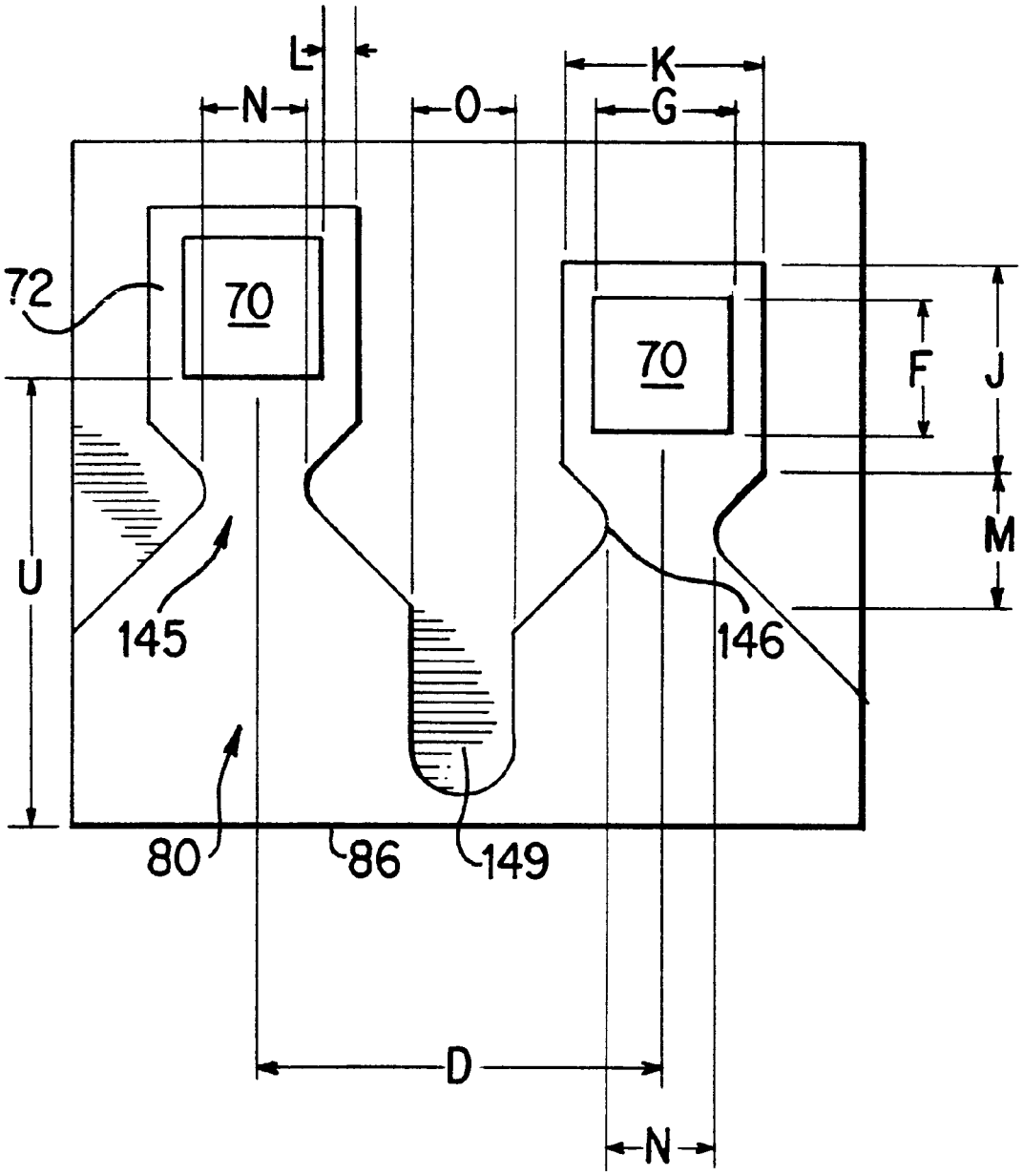
FIG. 6 is a top plan view of a magnified portion of the printhead assembly showing the relationship of ink channels, vaporization chambers, heater resistors, the barrier layer and an edge of the substrate.

In FIG. 6, vaporization chambers 72 and ink channels 80 are shown formed in barrier layer 30. Ink channels 80 provide an ink path between the source of ink and the vaporization chambers 72. The flow of ink into the ink channels 80 and into the vaporization chambers 72 is around the long side edges 86 of the substrate 28 and into the ink channels 80. The relatively narrow constriction points or pinch point gaps 145 created by the pinch points 146 in the ink channels 80 provide viscous damping during refill of the vaporization chambers 72 after firing. The pinch points 146 help control ink blow-back and bubble collapse after firing to improve the uniformity of ink drop ejection. The addition of "peninsulas" 149 extending from the barrier body out to the edge of the substrate provided fluidic isolation of the vaporization chambers 72 from each other. The definition of the various printhead dimensions are provided in Table I.

TABLE I

DEFINITION OF INK CHAMBER DEFINITIONS

| Dimension | Definition |
|---|---|
| A | Substrate Thickness |
| B | Barrier Thickness |
| C | Nozzle Member Thickness |
| D | Orifice/Resistor Pitch |
| E | Resistor/Orifice Offset |
| F | Resistor Length |
| G | Resistor Width |
| H | Nozzle Entrance Diameter |
| I | Nozzle Exit Diameter |
| J | Chamber Length |
| K | Chamber Width |
| L | Chamber Gap |
| M | Channel Length |
| N | Channel Width |
| O | Barrier Width |
| U | Shelf Length |

The frequency limit of a thermal inkjet print cartridge is limited by resistance in the flow of ink to the nozzle. However, some resistance in ink flow is necessary to damp meniscus oscillation. Ink flow resistance is intentionally controlled by the pinch point gap 145 gap adjacent the resistor. An additional component to the fluid impedance is the entrance to the firing chamber. The entrance comprises a thin region between the nozzle member 16 and the substrate 28 and its height is essentially a function of the thickness of the barrier layer 30. This region has high fluid impedance, since its height is small. The dimensions of the various elements formed in the barrier layer 30 shown in FIG. 6 are identified in Table II below.

TABLE II

INK CHAMBER DIMENSIONS IN MICRONS

| Dimension | Minimum | Nominal | Maximum |
|---|---|---|---|
| A | 600 | 625 | 650 |
| B | 19 | 25 | 32 |
| C | 25 | 50 | 75 |
| D | | 84.7 | |
| E | 1 | 1.73 | 2 |
| F | 30 | 35 | 40 |
| G | 30 | 35 | 40 |
| I | 20 | 28 | 40 |
| J | 45 | 51 | 75 |
| K | 45 | 51 | 55 |
| L | 0 | 8 | 10 |
| M | 20 | 25 | 50 |
| N | 15 | 30 | 55 |
| O | 10 | 25 | 40 |
| U | 0 | 90–130 | 270 |

The nozzle member 16 in circuit 18 is positioned over the substrate structure 28 and barrier layer 30 to form a printhead 14. The nozzles 17 are aligned over the vaporization chambers 72. Preferred dimensions A, B, and C are defined as follows: dimension A is the thickness of the substrate 28, dimension B is the thickness of the barrier layer 30, and dimension C is the thickness of the nozzle member 16. Further details of the printhead architecture are provided in U.S. application Ser. No. 08/319,893, filed Oct. 6, 1994, entitled "Barrier Architecture for Inkjet Printhead, now U.S. Pat. No. 5,594,481;" which is herein incorporated by reference.

From Table II it can be seen that the nominal channel width of 30 microns and nominal channel height of 25 microns, allows for channel blockage by very small bubble diameters.

Figure 7:
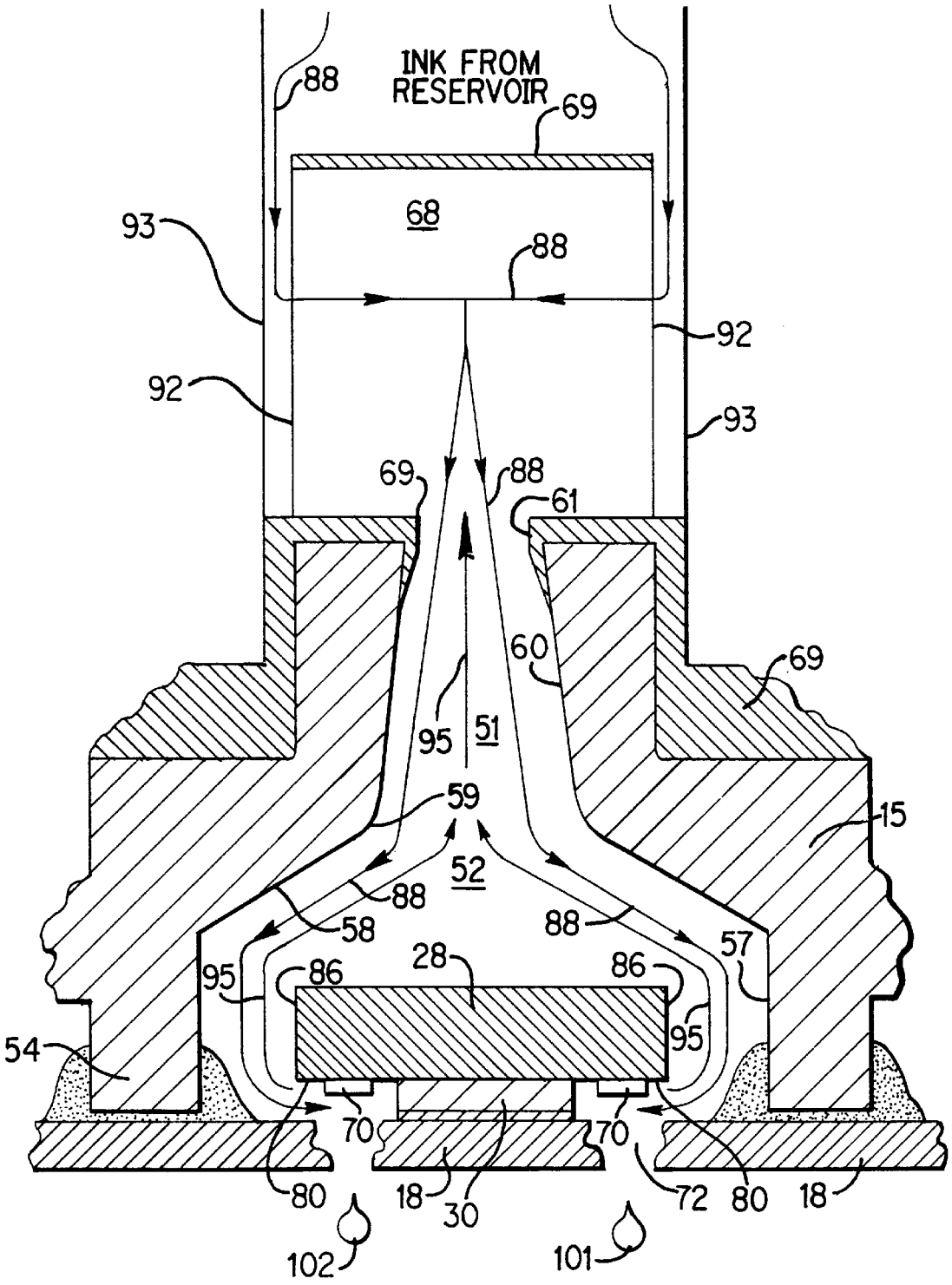
FIG. 7 is a schematic diagram showing the ink flow path from the ink reservoir to the printhead.

FIG. 7 shows how ink containing dissolved gases flows from the ink reservoir 12 of the ink cartridge 10 through filters 92 along ink flow path 88 through standpipe 51 in the snout 11, into manifold 52, around the edge 86 of substrate 28, along ink channels 80 and into vaporization chambers 72 before being ejected out of the nozzles 17. During operation, warm thermal boundary layers of ink 88 form adjacent the substrate 28. Therefore, dissolved gases in the thermal boundary layer of the ink 88 behind the substrate 28 tend to form and diffuse into the bubbles 91. Also, bubbles 91 tend to form at the corners and edges of the walls 57, 58 and 68 along the ink flow path 88. In addition, the region between the manifold 52 and substrate 28 acts as an accumulator or bubble trap. This configuration amounts to a chamber on the ink flow path 88 with an entrance and an exit. The average ink flow rate, in terms of volume ink per cross section of area per second, is smaller within the chamber than at the entrance or at the exit. The entrance edge of the chamber will act as a gas generating site because of its sharpness and because of the discontinuity of ink flow over the edge. Bubbles will be generated in this chamber and when they become large enough they get moved along toward the ink chamber. If the chamber allows bubbles to grow larger than the diameter of subsequent ink passageways which may then become blocked. These bubbles choke the flow of ink to the vaporization chambers 72, especially at high ink flow rates. Ink flow rate increase with drop volume, number of nozzles, firing frequencies and power or heat input. High flow rates result in causing some of the nozzles 17 to temporarily become inoperable. Although the total amount of dissolved gases contained within the fluid volume of the boundary layer is small, in reality, all of the ink in the reservoir 12 will eventually flow along ink path 88 over the lifetime of the print cartridge 10. If all, or even some, of the dissolved gas contained within the ink reservoir 12 outgasses, substantial bubbles will form. When the bubbles become large enough they get moved along toward the ink chamber. If the bubbles grow larger than the diameter of subsequent ink passageways, the passageways may become blocked and choke the flow of ink to the vaporization chambers 72. This results in causing some of the nozzles 17 to temporarily become inoperable.

Bubbles in the ink near the printhead 14 of an inkjet print cartridge 10 is one of the most critical problems that impairs the performance of the print cartridge. Bubbles arise from several causes: (1) bubbles are trapped in the ink feed channels during filling and priming of the print cartridge and (2) bubbles are formed at bubble "seed sites" in the fibrous carbon-filled material of walls 57, 58, 60 of the print cartridge body 15 during operation. As the ink is heated during printing, dissolved air outgasses from the ink and is accreted onto these trapped bubbles and seed sites, resulting in bubbles that grow over time. The bubbles block the nozzles 17 from ejecting ink and if the blockage is large enough it can cause the entire printhead 14 to suffer "global starvation." Bubbles have been a problem in the past, but they are a much more serious problem in a 600 dot per inch ("dpi") printhead. This is due primarily to the reduced size of the ink flow channels 80 and nozzles 17 diameter as set forth in the above description with respect to FIG. 6 and accompanying Table II. However, this is also due to the higher firing frequencies and consequent increased ink flow rates. Because the venturi forces that pull bubbles toward the firing chambers are now higher, the tendency for bubbles to interfere with nozzle operation is greater.

An important aspect of bubble control is the design of a bubble tolerant internal cartridge geometry. Until recently inkjet technology has been characterized by relatively low resolution, low frequency printing. At these ink flow rates bubbles do not typically cause starvation effects. However, for resolutions at or above 600 dpi and drop ejection frequencies at or above 12 kHz, the relative ink flow rate can he higher by a factor of 3 or more. Bubbles in the ink manifold region adjacent to the ink ejectors will typically expand sufficiently to induce starvation effects at this flow rate and the associated temperature rise. Unfortunately, this problem is also characterized by "thermal runaway" such that attempting to energize heater resistors during a period of bubble-induced starvation fails to result in drop ejection which is the main path of heat flux out of the printhead.

In prior printhead manifold architectures the printhead is located adjacent to the manifold walls. This close proximity enables bubbles that grow during operation to become trapped in the ink channels. During subsequent operation the pressure drop and temperature rise during high duty cycle printing cause these bubbles to expand such that ink flow to ink ejectors is cut off. This failure mode is commonly known as starvation, or more specifically as bubble-induced starvation. It is manifested during printing as a marking pattern which is complete at the beginning of a swath but which fades or abruptly stops within the early portion of the swath. Because this failure mode develops with continued operation it is a reliability problem which cannot be initially tested at the printhead manufacturing site. Though initial bubbles can be prevented or eliminated through appropriate ink fill and priming processes, the chance that a bubble is ingested through a nozzle during operation cannot be prevented. Therefore, the printhead and ink manifold architecture must be designed to be tolerant of bubbles.

Most thermal inkjet devices are designed to operate in an orientation such that drops are fired in a direction substantially parallel with the acceleration vector of gravity. As a result, the buoyancy force on bubbles in the manifold region will tend to pull them away from the ink ejectors. However, bubbles can become large enough to become trapped before their buoyancy force would overcome the surface adhesion forces to the ink manifold walls or printhead surfaces. This invention solves the problem by creating an ink manifold geometry of a size and shape sufficient for outgassed bubbles to float away during the course of normal operation from the narrow region where starvation can be induced.

The most critical areas for the design is the area around the substrate, headland or manifold, standpipe and filter. The goals are to minimize dead spaces, streamline the geometry for fluid flow to avoid trapping bubbles during initial priming and to provide a clear path to allow for buoyancy to maximize the easy escape of bubbles, in the direction 95 shown in FIG. 7 which coincides with the ink flow path 88, but in the opposite direction. The bubbles flow from the printhead area into the ink manifold 52 and then float through standpipe 51 and into the filter cage area 68. Since the print cartridge prints with the nozzles downward, the ink manifold area behind the printhead substrate was redesigned to provide clear space under the substrate to allow bubbles to easily escape upward away from the printhead area.

Figure 8:
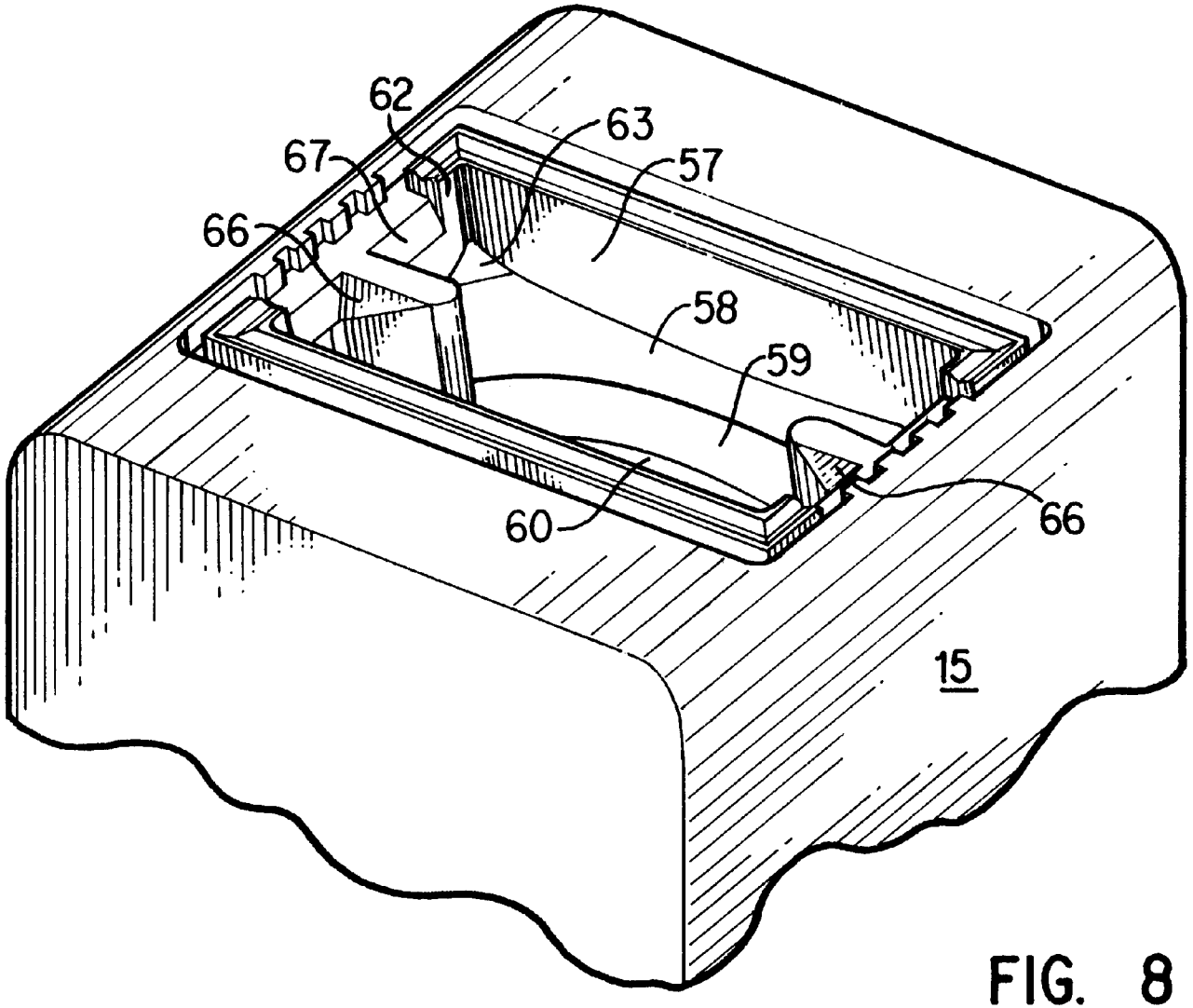
FIG. 8 is a perspective view of the manifold area of the inkjet print cartridge of the present invention.
Figure 9:
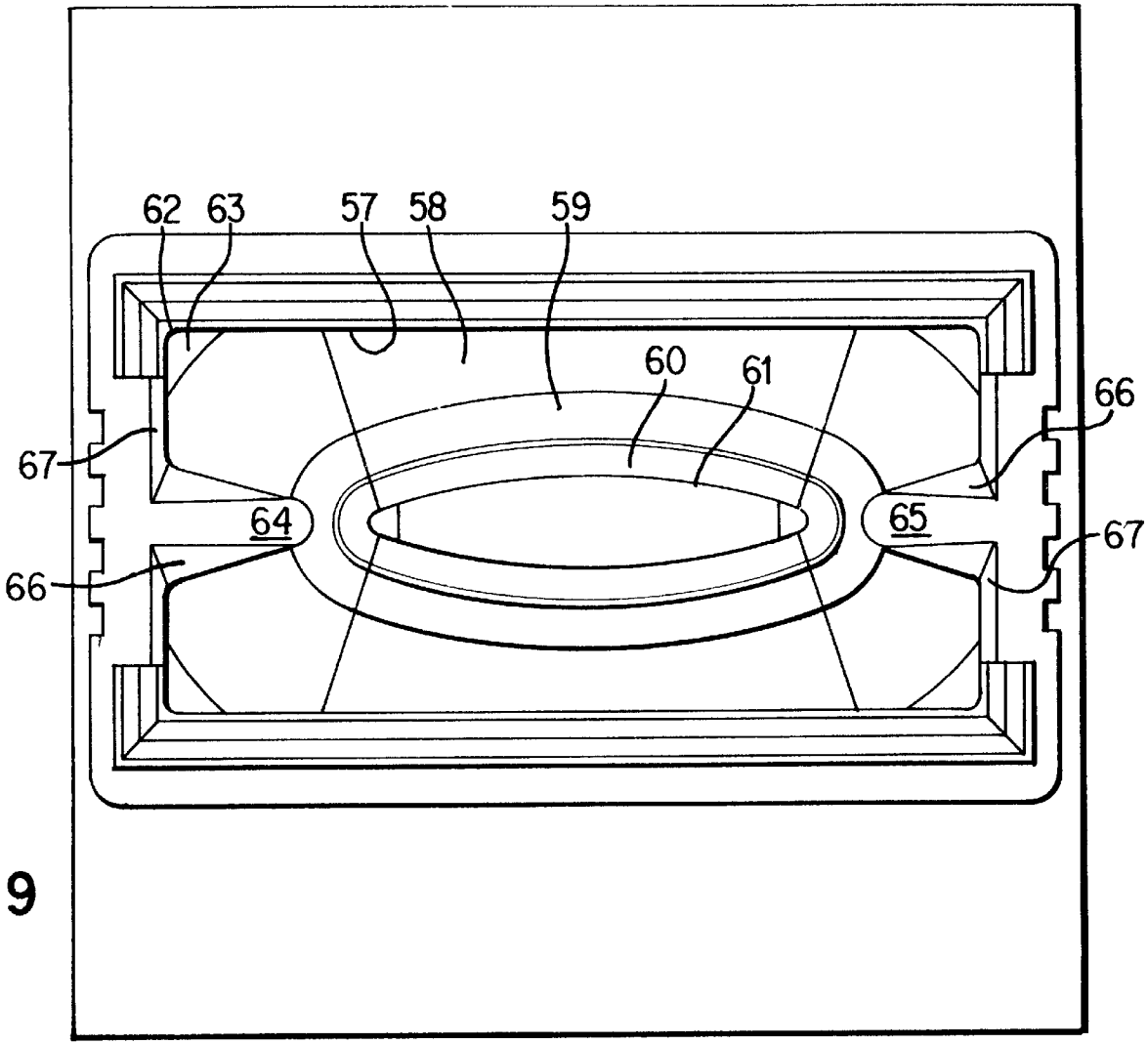
FIG. 9 is a top plan view of the manifold area of the inkjet print cartridge of the present invention.

This new manifold design is shown in perspective view in FIG. 8 and in top plan view in FIG. 9. The manifold area 52 was made deeper by lengthening or deepening upper manifold walls 57 to between approximately 2 and 3 mm from 0.5 mm and increasing the angle of lower manifold walls 58 from the bottom surface of the substrate 28 to a range of approximately 20 to 30 degrees from horizontal, making the manifold walls 58 steeper and thus, the manifold 52 deeper than in previous ink cartridge designs, thus making it easier for bubbles to drift upward into standpipe 51 and away from the nozzles 17 and ink channels 80. The junction 59 between lower manifold wall 58 and the internal wall 60 of standpipe 51 was rounded to make it easier for bubbles to enter the standpipe 51 from the manifold 52.

The corners 62 were rounded to help prevent the trapping of bubbles and fillets 63 were also formed in the corner of upper manifold walls 57 and lower manifold walls 58 in the manifold 52 to help prevent the trapping of bubbles. The length of substrate supports 64, 65 was reduced to accommodate a longer standpipe and the ends of the substrate supports were rounded. Also, the side walls 66 of substrate supports 64, 65 were sloped downward at an angle of approximately 50 to 60 degrees, to allow the adhesive to flow away from substrate 28 and prevent the adhesive from trapping of bubbles. For the same reason walls 67 of the manifold were sloped downward at an angle of approximately 70 to 75 degrees.

The internal cross-section of the standpipe 51 was enlarged from approximately 15 to 20 square millimeters, in part by minimizing the wall thickness of the standpipe 51. The shape of internal wall 60 of standpipe 51 was modified into an approximation of an elliptical cylinder with tangential circular cylindrical surfaces while maintaining the desired taper angle of approximately 2 degrees. The external wall (not shown) of the standpipe 51 was also modified into approximately the same shape as the inner wall 60 of the standpipe 51 and was given a reverse taper of approximately 6 degrees to better secure the inner frame to the standpipe.

Referring also to FIG. 7, the exit area 61 of standpipe 51 into filter cage area 68 (shown in FIG. 7) was maximized utilizing a slightly divergent profile. The amount of the inner frame 69 material extending into standpipe 51, below the filter cage area 68 and where the ink reservoir bag 93 is attached to inner frame 69, was minimized and tapered appropriately. Further details regarding the inner frame 69 and filter cage area 68 which are located above the standpipe 51 are set forth in U.S. application Ser. No. 07/995,109, filed Dec. 22, 1992, entitled TWO MATERIAL FRAME HAVING DISSIMILAR PROPERTIES FOR THERMAL INKJET CARTRIDGE, now U.S. Pat. No. 5,426,459, which is incorporated herein by reference.

Experiments verified that the new manifold design allows the bubbles in the ink channels, manifold area and standpipe to migrate more easily upward to regions of the ink cartridge where the presence of bubbles is not damaging to the operation of the printhead. Equally important, the new manifold design greatly reduced the tendency of bubbles in the ink manifold region adjacent to the ink ejectors to expand sufficiently to induce starvation effects at high ink flow rates and temperature rise. Also, bubbles tend not to cause starvation even the bubbles are free to expand. Thus, performance has been increased over the life of the print cartridge with fewer ink channel bubble blockages than previous manifold designs.

It will be understood that the foregoing disclosure is intended to be merely exemplary, and not to limit the scope of the invention, which is to be determined by reference to the appended claims.

What is claimed is:

1. A method of ink delivery in an inkjet print cartridge to a printhead having ink vaporization chambers, the method comprising the steps of:

providing a supply of ink in an ink supply chamber of said print cartridge;

providing a tapered ink passageway having internal walls which taper from an area proximate to said printhead to an ink entrance receiving said supply of ink, wherein the internal walls of the ink passageway are located and oriented to allow bubbles formed by gases released by the ink to escape through the ink passageway away from the ink vaporization chambers and into said ink supply chamber without interfering with a flow of ink into the ink vaporization chambers, said tapered ink passageway comprising first tapered walls proximate said printhead and second tapered walls leading from said first tapered walls and terminating proximate to said ink supply chamber, said second tapered walls having less of an angle relative to a central axis of said ink passageway than said first tapered walls; and transporting ink from the ink supply chamber through said tapered ink passageway in a first direction while said bubbles, forming proximate to said printhead, move in a second direction, opposite said first direction, so as not to interfere with the flow of ink into the ink vaporization chambers.

2. The method of claim 1, wherein said tapered ink passageway includes a manifold portion in which the printhead resides, said manifold portion having said first tapered walls forming lower manifold walls and non-tapered walls at least partially surrounding the printhead, said non-tapered walls having a length from a termination of said non-tapered walls to said lower manifold walls between approximately 2 and 3 mm, said step of transporting ink comprising transporting ink along said lower manifold walls and said non-tapered walls into said ink vaporization chambers.

3. The method of claim 2, wherein a junction between said lower manifold walls and said second tapered walls is a rounded junction, said step of transporting ink comprising flowing ink through said second tapered walls along said rounded junction and along said lower manifold walls into said ink vaporization chambers.

4. The method of claim 2, wherein said lower manifold walls have an angle of between 20 to 30 degrees relative to a central axis of said tapered ink passageway, said step of transporting ink along said lower manifold walls comprising transporting said ink alone said lower manifold walls at between 20 to 30 degrees relative to said central axis of said tapered ink passageway.

5. A method of ink delivery in an inkjet print cartridge to a printhead having ink vaporization chambers, the method comprising the steps of:

providing a supply of ink in an ink supply chamber of said print cartridge;

providing a tapered ink passageway having a standpipe portion extending from an ink entrance from said ink supply chamber to a manifold portion, and wherein the manifold portion has inner walls which taper from an area proximate to said printhead to a junction with said standpipe portion and wherein the standpipe portion has inner walls which taper from said junction to an area proximate to said ink entrance, and wherein said inner walls of said manifold portion and said standpipe portion are located and oriented to allow bubbles, formed by gases being released by the ink, to escape through the ink passageway away from the ink vaporization chambers and into said ink supply chamber without interfering with a flow of ink into the ink vaporization chambers; and transporting ink from the ink supply chamber through said tapered ink passageway in a first direction and in a first flow region, while said bubbles, forming proximate to said printhead, move in a second direction, opposite to said first direction, and in a second flow region disposed outside of the first flow region, so as not to interfere with the flow of ink into the ink vaporization chambers, wherein said manifold portion tapered walls have a first angle with respect to a central axis of said tapered ink passageway and said standpipe portion tapered walls have less of an angle relative to said central axis of the ink passageway.

6. The method of claim 5, wherein said junction is a rounded junction, said step of transporting ink comprising flowing ink through said standpipe portion along said standpipe portion tapered walls, over said rounded junction and along said manifold portion tapered walls into said ink vaporization chambers.

7. The method of claim 5 wherein said manifold portion tapered walls forming lower manifold walls and non-tapered walls at least partially surrounding the printhead, said non-tapered walls having a length from a termination of said non-tapered walls to said lower manifold walls between approximately 2 and 3 mm, said step of transporting ink comprising transporting ink along said lower manifold walls and said non-tapered walls into said ink vaporization chambers.

8. The method of claim 7, wherein said manifold portion tapered walls have an angle of between 20 to 30 degrees relative to a central axis of said tapered ink passageway, said step of transporting ink along said manifold portion tapered walls comprising transporting said ink along said manifold portion tapered walls at between 20 to 30 degrees relative to said central axis of said tapered ink passageway.

* * * * *